US008101122B2

(12) United States Patent
Hawk

(10) Patent No.: US 8,101,122 B2
(45) Date of Patent: Jan. 24, 2012

(54) NICRMOCB ALLOY WITH IMPROVED MECHANICAL PROPERTIES

(75) Inventor: Jeffrey Allen Hawk, Corvallis, OR (US)

(73) Assignee: General Electric Company, Schenectady, NY (US)

( * ) Notice: Subject to any disclaimer, the term of this patent is extended or adjusted under 35 U.S.C. 154(b) by 359 days.

(21) Appl. No.: 12/436,194

(22) Filed: May 6, 2009

(65) Prior Publication Data

US 2010/0284850 A1 Nov. 11, 2010

(51) Int. Cl.
*C22C 19/05* (2006.01)
*C22F 1/10* (2006.01)

(52) U.S. Cl. ..... 420/448; 148/410; 148/675

(58) Field of Classification Search ..... 420/448; 148/410, 675
See application file for complete search history.

(56) References Cited

U.S. PATENT DOCUMENTS 3,046,108 A 7/1962 Eiselstein
3,160,500 A 12/1964 Eiselstein et al.
4,818,301 A * 4/1989 Khare ..... 419/1
5,509,784 A 4/1996 Caruso et al.
6,531,002 B1 * 3/2003 Henry et al. ..... 148/409
7,270,518 B2 9/2007 Barb et al.
7,344,359 B2 3/2008 Deallenbach

OTHER PUBLICATIONS

ASM International, Materials Park, Ohio, ASM Specialty Handbook: Nickel, Cobalt, and Their Alloys, "Metallography and Microstructures of Heat Resistant Alloys", Dec. 2000, pp. 302-304.*

* cited by examiner

*Primary Examiner* — Jessee R. Roe
(74) *Attorney, Agent, or Firm* — Hoffman Warnick LLC; Ernest G. Cusick

(57) ABSTRACT

The invention includes a turbine cover bucket of an alloy including carbon at less than approximately 0.04 weight percent, manganese at approximately 0.0-0.2 weight percent, silicon at approximately 0.0-0.25 weight percent, phosphorus at approximately 0.0-0.015 weight percent, sulfur at approximately 0.0-0.015 weight percent, chromium from approximately 20.0-23.0 weight percent, molybdenum from approximately 8.5-9.5 weight percent, niobium from approximately 3.25-4 weight percent, tantalum at approximately 0.0-0.05 weight percent, titanium from approximately 0.2-0.4 weight percent, aluminum from approximately 0.15-0.3 weight percent, iron from approximately 3.0-4.5 weight percent, and the remainder being nickel. The alloy is heat treated at 538° C. to 760° C. for up to 100 hours. A method of manufacturing the turbine bucket cover is also provided.

9 Claims, No Drawings

NICRMOCB ALLOY WITH IMPROVED MECHANICAL PROPERTIES

BACKGROUND OF THE INVENTION

The invention relates to an improved nickel-chromium-molybdenum-niobium (NiCrMoNb) alloy especially suitable for turbine cover buckets.

In U.S. Pat. Nos. 5,509,784, 7,270,518 and 7,344359, a plurality of steep angle bucket covers are disclosed. The covers are integral with the airfoils of the buckets and the buckets, are mounted in a circumferential array about a turbine wheel. The bucket covers include forward and aft clearance surfaces which extend generally parallel to the axis of rotation of the turbine rotor and lie on opposite sides of the airfoil of the bucket. Intermediate the clearance surfaces are contact surfaces and a radii. It will be appreciated that the adjacent covers on the opposite sides of each bucket include substantially complementary shaped cover edges whereby the clearance surfaces are circumferentially spaced from one another and the contact surfaces contact one another during turbine operation. The contact surfaces of the adjoining covers have interference fits which cause and maintain a coupling between the covers during operation. That is, the covers are biased such that the contact surfaces of the adjoining covers are maintained in contact with one another. This, however, applies a stress to the covers which has the potential to cause high cycle fatigue cracks along the covers. Analysis of the potential problem has indicated that the high cycle fatigue cracks are a function of fretting fatigue on the pressure side of the cover's contact surface. The cracks are initiated on the pressure side contact surface at a location adjacent the inner corner radius between the clearance surfaces where the mating suction side cover contact surface separates from the pressure side contact surface.

U.S. Pat. Nos. 3,046,108 and 3,160,500 disclose nickel chromium alloys having certain advantageous properties. These alloys are referred to as alloy 625. Alloy 625 is not used in certain high temperature applications because it lacks the necessary yield strength.

SUMMARY OF THE INVENTION

Embodiments of the invention include a turbine cover bucket of an alloy including carbon at less than approximately 0.04 weight percent, manganese at approximately 0.0-0.2 weight percent, silicon at approximately 0.0-0.25 weight percent, phosphorus at approximately 0.0-0.015 weight percent, sulfur at approximately 0.0-0.015 weight percent, chromium from approximately 20.0-23.0 weight percent, molybdenum from approximately 8.5-9.5 weight percent, niobium from approximately 3.25-4 weight percent, tantalum at approximately 0.0-0.05 weight percent, titanium from approximately 0.2-0.4 weight percent, aluminum from approximately 0.15-0.3 weight percent, iron from approximately 3.0-4.5 weight percent, and the remainder being nickel.

Embodiments of the invention include a turbine cover bucket of an alloy consisting essentially of carbon at less than approximately 0.04 weight percent, manganese at approximately 0.0-0.2 weight percent, silicon at approximately 0.0-0.25 weight percent, phosphorus at approximately 0.0-0.015 weight percent, sulfur at approximately 0.0-0.015 weight percent, chromium from approximately 20.0-23.0 weight percent, molybdenum from approximately 8.5-9.5 weight percent, niobium from approximately 3.25-4 weight percent, tantalum at approximately 0.0-0.05 weight percent, titanium from approximately 0.2-0.4 weight percent, aluminum from approximately 0.15-0.3 weight percent, iron from approximately 3.0-4.5 weight percent, and the remainder being nickel.

Embodiments of the present invention also include a method of manufacturing a turbine bucket cover. The method includes thermomechanically forming a turbine bucket cover from an alloy including carbon at less than approximately 0.04 weight percent, manganese at approximately 0.0-0.2 weight percent, silicon at approximately 0.0-0.25 weight percent, phosphorus at approximately 0.0-0.015 weight percent, sulfur at approximately 0.0-0.015 weight percent, chromium from approximately 20.0-23.0 weight percent, molybdenum from approximately 8.5-9.5 weight percent, niobium from approximately 3.25-4 weight percent, tantalum at approximately 0.0-0.05 weight percent, titanium from approximately 0.2-0.4 weight percent, aluminum from approximately 0.15-0.3 weight percent, iron from approximately 3.0-4.5 weight percent, and the remainder being nickel. The turbine bucket cover is heat treated at approximately 538° C. to 760° C. for up to 100 approximately hours.

The above described and other features are exemplified by the following detailed description.

DETAILED DESCRIPTION

Embodiments of the present invention provide an alloy with improved yield strength, creep and stress relaxation characteristics, and excellent corrosion resistance in steam and can be used as an integrally coupled bucket (ICB) component. It has been found that a tightened chemistry and a specific heat treatment process procedure provide an alloy that retain critical aspects of the deformed microstructure and produces gamma double prime (γ") strengthening precipitates. These γ" precipitates constitute an ordered nickel niobium phase in the alloy.

The chemistry of the alloy used in embodiments of the invention are a maximum loading 0.04 weight percent (w/o) carbon (C), a maximum loading of 0.2 w/o manganese (Mn), a maximum loading of 0.25 w/o silicon (Si), a maximum loading of 0.015 w/o phosphorus (P), a maximum loading of 0.015 w/o sulfur (S), from about 20.0 to 23.0 w/o chromium (Cr), from about 8.5 to 9.5 w/o molybdenum (Mo), from about 3.25 to 4.00 w/o columbium (also referred to niobium) (Nb), a maximum loading of 0.05 w/o tantalum (Ta), from about 0.0 to 0.40 w/o titanium (Ti), from about 0.15 to 0.30 w/o aluminum (Al), a maximum loading of 0.005 w/o boron (B), from about 3.0 to 4.5 w/o iron (Fe), and all sub-ranges therebetween with the remainder being nickel (Ni). For purposes of this disclosure this alloy is referred to as alloy 625. The aging heat treatment used improve the characteristics of alloy 625 are treating the article at a temperature of from 538° C. (1000° F.) to 760° C. (1400° F.) for times up to 100 hours. A preferred heat treatment is to treat the article at approximately 677° C. (1250° F.) for approximately 50 hours.

The heat treatment process procedure is used after any metal forming process but is specific to bar, plate, sheet or forged products. After thermomechanical processing into the requisite bucket shape, the aging heat treatment to produce the heat treated alloy 625 is performed, whereby alloy 625 is either given a low temperature anneal (less than 954° C. (1750° F.) for less than 1 hour) or no anneal prior to heat treatment in the range of 538° C. (1000° F.) to 760° C. (1400° F.) for times up to 100 hours. In the specific case of round bar, the heat treatment sequence can include the following steps: bar forming followed by mill anneal at 954° C. (1750° F.) for 30 minutes, or any suitable time and temperature heat treatment at less than 982° C. (1800° F.), or no mill anneal, followed by heat treatment at 677° C. (1250° F.) for 50 hours.

The heat treatment of the 625 alloy is used to impart secondary strength through retention of the dislocation substructure (via component forming operation) and γ" precipitate development. The composition of the 625 alloy is similar to the chemistry specified in AMS5666F (SAE Standards) but is more precise. This more precisely defined chemistry window provides uniformity in manufacture of alloy 625.

AMS5666F provides a loose framework for defining the limits of alloy 625 chemistry. A preferred chemistry as specified above for alloy 625 allows use of alloy 625 for high pressure/intermediate pressure (HP/IP) buckets. Heat treated alloy 625 is suitable for steam applications and because retention of the dislocation substructure produced during mechanical deforming processing and γ" strengthening precipitates, the heat treated alloy 625 possesses additional yield strength and stress relaxation capability.

In order to maximize γ" strengthening precipitates, the carbon level must be below 0.04 w/o. In contrast, the maximum carbon limit for AMS5666F is 0.1 w/o. A carbon level in excess of 0.04 w/o interferes with γ" formation by using solute from the matrix, primarily Nb (niobium, also called columbium), to form carbide. In addition, Nb must be sufficient to form γ" (i.e., $Ni_3Nb$ with an ordered body centered tetragonal crystal structure which is coherent with the γ Ni matrix) and Al and Ti (i.e., 0.35 to 0.70 w/o: Al+Ti) must be present in sufficient quantities as both can substitute for Nb in the γ" precipitate lattice.

The aging heat treatment is used to form the γ" in the matrix prior to steam turbine operation in order to increase yield strength prior to integrated cover bucket (ICB) manufacture. Because alloy 625 is not specifically an age hardenable alloy, the heat treatment temperature used to form γ" must be such that sufficient time is available to nucleate and grow the γ", while at the same time not producing the equilibrium 6 phase (also $Ni_3Nb$ but with an orthorhombic crystal structure). In addition, the time and temperature for γ" formation must not be too high, less than 760° C. (1400° F.), or too long, greater than 100 hours, to adversely affect the dislocation substructure (i.e., the reduction of free dislocations in the γ Ni matrix). For operating temperatures less than 649° C. (1200° F.), once γ" has been formed through the aging heat treatment, the phase is relatively stable for long times and will not revert to the less desirable δ phase during operation. As such, strength is high from the beginning of the manufacturing process and remains at this high level throughout.

Stress-relaxation for any alloy used in the ICB design is critically important because the contacting force between the buckets in the row (at the points of contact) is the force that holds them in place during operation. For any ICB application a certain level of stress is required to keep the buckets in contact with each other for their 100,000 hour life. Certain alloys, like 10Cr steels have excellent yield strength and good creep resistance, but when tested for stress-relaxation, the strength drops off rapidly, falling below that threshold stress level for efficient bucket-to-bucket contact within the first 1000 hours of operational life. The 10Cr steel very quickly loses its strength at 600° C. (1110° F.). The 600° C. temperature is one of the operating conditions for ICBs. Stress relaxation tests on the mill annealed (MA) 625 alloy were conducted. This means it was formed into bar with whatever forming method used, then given a mill annealed, or low temperature, heat treatment. Although the performance was much better than 10Cr steel, it was not sufficient to meet the 100,000 hour bucket life goal. Extrapolation of existing data gives a bucket lifetime of about 30,000 hours.

Heat treated alloy 625 as specified above were tested. The stress relaxation performance of heat treated alloy 625 to provide a useful life for ICB of approximately 100,000 hours. In summary, 10Cr steel relaxes too quickly for the ICB bucket application at 600° C. Alloy 625 although providing improved performance relative to 10Cr steel, i.e., is not sufficient to meet target ICB lifetime. Heat treated alloy 625 provides 100,000 hour bucket target life.

Not wanting to be bound by theory it is thought that heat treated alloy 625 alleviates this problem by providing adequate stress-relaxation capability to meet the 100,000 hour life of the ICB component through retention of the dislocation substructure achieved during prior forming operations and via precipitation of γ". The precipitation of γ" and the retention of a high dislocation density from the manufacturing process insure adequate yield strength for bucket insertion during manufacture and stress-relaxation capability during steam turbine operation to meet design requirements of the ICB component.

Alloy 625 allows the use of ICB buckets in both high temperature (steam temperatures between 582 and 649° C.) and low temperature (corrosion resistance in addition to stress-relaxation capability) steam turbine offerings with concomitant improvement in overall turbine efficiency. Heat treated alloy 625 provides for 100,000 operational life of the ICB component in these steam turbines under normal operating conditions.

Previous bucket designs have used peened-on bucket covers. The new ICB design uses the contact force (interference fit) between adjacent buckets to hold the bucket row together for steam turbines. Peening on covers is not an option if efficiency improvements are desired in order to make the steam turbine more attractive to customers. The use of heat treated alloy 625 allows ICB buckets to be used in the first 2-3 bucket rows in the HP/IP of steam turbines at temperatures in excess of 582° C. for prolonged operating times. The heat treated 625 alloy can also be used in low pressure rows of in an Integrated Water and Power Product.

The heat treatment window is from 538 to 760° C. for times up to 100 hours. Treating alloy 625 at temperatures lower than 538° C., or greater than 760° C., which requires either extended heat treatment time in the low temperature regime (greater than 100 hours) or very short heat treatment time at the high temperature regime (less than 10 hours) with uncertainty of achieving greater than 90 ksi yield strength that is needed for the ICB applications. The problem with these heat treatment processes is that they create a dual phase structure of γ" and 6 (the less desirable equilibrium phase) at high temperatures (greater than 760° C.) and not creating γ" at the lower aging temperatures (less than 538° C.). Temperatures less than 538° C. require long aging times to produce equivalent strength while temperatures greater than 760° C. are complicated by δ formation.

The formation of γ" and dislocation retention are critical to this invention. Chemistry, while still within the nominal range of AMS5666F, is tightened for critical elements C, Nb, Al and Ti, to insure sufficient γ" is available for strength. The heat treatment window provides latitude to form γ" without concomitant loss in strength due to dislocations reduction.

EXAMPLES

Four heat treatments of alloy 625 were conducted, the alloy was obtained from four different sources. Table 1 lists the compositions of the 4 samples A-D, along with the minimum and maximum amounts of elements in alloy 625 for embodiments of the present invention.

TABLE 1

| Nominal Chemical Composition and Heat Chemistry (weight percent) | | | | | | |
|---|---|---|---|---|---|---|
| Element | Min | Max | A | B | C | D |
| Ni | balance | | 60.40 | 61.89 | 61.50 | 61.34 |
| Cr | 20.00 | 23.00 | 22.15 | 21.73 | 21.75 | 21.01 |
| Mo | 8.5 | 9.50 | 9.08 | 8.82 | 8.69 | 8.65 |
| C | 0.0 | 0.04 | 0.029 | 0.020 | 0.020 | 0.057 |
| Mn | 0.0 | 0.20 | 0.20 | 0.08 | 0.07 | 0.07 |
| P | 0.0 | 0.015 | 0.005 | 0.007 | 0.007 | 0.014 |
| S | 0.0 | 0.015 | 0.001 | 0.001 | 0.001 | 0.0003 |
| Si | 0.0 | 0.25 | 0.21 | 0.08 | 0.06 | 0.245 |
| Fe | 3.0 | 4.5 | 3.71 | 3.42 | 3.68 | 4.43 |
| Nb | 3.25 | 4.00 | 3.49 | 3.37 | 3.47 | 3.44 |
| Ta | 0.0 | 0.05 | <0.01 | <0.01 | <0.01 | <0.01 |
| Co | 0.0 | 1.00 | 0.18 | 0.12 | 0.21 | 0.11 |
| Al | 0.15 | 0.30 | 0.17 | 0.22 | 0.26 | 0.22 |
| Ti | 0.20 | 0.40 | 0.29 | 0.24 | 0.28 | 0.26 |

Tensile and creep strength and stress-relaxation were measured for the as-received (i.e., mill annealed, prior to heat treatment) alloy and for material given a specific heat treatment of 50 hours at 677° C. Yield strength, creep life and stress-relaxation response were evaluated for each heat treated alloy 625. The room temperature yield strength (mean) for the heat treated alloys (samples A-D) was 99 ksi, well above the nominal 60 ksi minimum of low solution annealed alloy 625. At the operating temperature of the 1000 MW steam turbine (600° C.), stress relaxation at 0.25% strain for four samples was sufficient to provide 100,000 hour life for the ICB. Non heated treated samples did not provide sufficient life at 0.25% strain at 600° C. Creep strength of heat treated alloy 625 was improved over the non heat treated alloy 625.

Of the four tested samples, the main chemistry difference is carbon level in heat D which is above the maximum threshold of 0.04 weight percent. It is required that the carbon level be at 0.04 weight percent, or lower, preferably equal to, or lower than, 0.03%. At levels above 0.03%, and certainly at levels above 0.04%, the carbon tends to form carbide with solute elements rather than be available for use in the strengthening precipitates.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context, (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about or approximately 25 w/o, or, more specifically, about or approximately 5 w/o to about or approximately 20 w/o", are inclusive of the endpoints and all intermediate values of the ranges of "about 5 w/o to about 25 w/o," etc and sub-ranges therebetween).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A turbine cover bucket comprising:

an alloy comprising carbon at less than approximately 0.04 weight percent, manganese at approximately 0.0-0.2 weight percent, silicon at approximately 0.0-0.25 weight percent, phosphorus at approximately 0.0-0.015 weight percent, sulfur at approximately 0.0-0.015 weight percent, chromium from approximately 20.0-23.0 weight percent, molybdenum from approximately 8.5-9.5 weight percent, niobium from approximately 3.25-4 weight percent, tantalum at approximately 0.0-0.05 weight percent, titanium from approximately 0.2-0.4 weight percent, aluminum from approximately 0.15-0.3 weight percent, iron from approximately 3.0-4.5 weight percent, and the remainder being nickel, wherein the alloy comprises γ" phase precipitates of tri-nickel-niobium ($Ni_3Nb$) and is free of δ phase tri-nickel-niobium $Ni_3Nb$ precipitates.

2. The turbine cover bucket of claim 1, wherein the alloy comprises a room temperature yield strength of greater than 90 kilo pound force per square inch (ksi).

3. The turbine cover bucket of claim 1, wherein the alloy has been heat treated at approximately 677° C. for approximately 50 hours.

4. The turbine cover bucket of claim 1, wherein the alloy is heat treated at 538° C. to 760° C. for up to 100 hours.

5. The turbine cover bucket of claim 1, wherein the alloy comprises carbon at less than 0.03 weight percent.

6. A turbine cover bucket consisting essentially of:

an alloy of carbon at less than approximately 0.04 weight percent, manganese at approximately 0.0-0.2 weight percent, silicon at approximately 0.0-0.25 weight percent, phosphorus at approximately 0.0-0.015 weight percent, sulfur at approximately 0.0-0.015 weight percent, chromium from approximately 20.0-23.0 weight percent, molybdenum from approximately 8.5-9.5 weight percent, niobium from approximately 3.25-4 weight percent, tantalum at approximately 0.0-0.05 weight percent, titanium from approximately 0.2-0.4 weight percent, aluminum from approximately 0.15-0.3 weight percent, iron from approximately 3.0-4.5 weight percent, and the remainder being nickel, wherein the alloy comprises γ" phase precipitates of tri-nickel-niobium ($Ni_3Nb$) and is free of δ phase tri-nickel-niobium $Ni_3Nb$ precipitates.

7. The turbine cover bucket of claim 6, wherein the alloy has been heat treated at approximately 677° C. for approximately 50 hours.

8. The turbine cover bucket of claim 6, wherein the alloy is heat treated at approximately 538° C. to 760° C. for up to approximately 100 hours.

9. The turbine cover bucket of claim 6, wherein the alloy comprises carbon at less than 0.03 weight percent.

* * * * *

UNITED STATES PATENT AND TRADEMARK OFFICE

CERTIFICATE OF CORRECTION

PATENT NO. : 8,101,122 B2
APPLICATION NO. : 12/436194
DATED : January 24, 2012
INVENTOR(S) : Hawk It is certified that error appears in the above-identified patent and that said Letters Patent is hereby corrected as shown below:

IN THE SPECIFICATIONS:

Column 3, line 36

Delete:

"the equilibrium 6 phase"

Insert:

-- the equilibrium δ phase --

Column 4, line 48

Delete:

"and 6"

Insert:

-- and δ --

Signed and Sealed this
First Day of May, 2012

David J. Kappos

David J. Kappos
*Director of the United States Patent and Trademark Office*